United States Patent [19]

Fey

[11] Patent Number: 4,534,188

[45] Date of Patent: Aug. 13, 1985

[54] TILT WASHER WITH AUTOMATIC LID

[75] Inventor: Robert M. Fey, Rocky Face, Ga.

[73] Assignee: Speed Queen Company, Ripon, Wis.

[21] Appl. No.: 615,859

[22] Filed: May 31, 1984

[51] Int. Cl.[3] ..... D06F 29/02

[52] U.S. Cl. ..... 68/3 R; 68/20; 68/210; 312/272

[58] Field of Search ..... 68/3 R, 19.2, 20, 26, 68/210; 312/271, 272; 134/84

[56] References Cited

FOREIGN PATENT DOCUMENTS 1155017 11/1957 France ..... 68/26

129357 9/1950 Sweden ..... 68/26

*Primary Examiner*—Philip R. Coe

*Assistant Examiner*—Frankie L. Stinson

*Attorney, Agent, or Firm*—William R. Clark; Joseph D. Pannone

[57] ABSTRACT

A top loading clothes washer adapted for installation under a fixed or stationary upper structure such as a stacked dryer or countertop wherein the washer is pivotable to a forward tilt-out position providing access to the top and wherein a washer lid in sliding engagement with the top is automatically opened as a result of the tilt-out movement of the washer. Apparatus connected to the lid restrains its forward movement so that it is prevented from moving out from under the dryer or countertop as the top of the washer tilts forward.

15 Claims, 19 Drawing Figures

TILT WASHER WITH AUTOMATIC LID

BACKGROUND OF THE INVENTION

In some clothes washer installations, it is desirable to have a top loading clothes washer that tilts forward to provide access for loading and unloading clothes. For example, in one application where floor space is at a premium, a clothes dryer can be stacked on top of the washer. In another application, it is desirable to position a clothes washer underneath a stationary countertop. If the washer is tilted forward to provide access to its top for loading and unloading clothes, the angle of tilt has to be very large before the opening of a conventional washer top is completely clear of the stationary overhead structure so that a conventional hinged washer lid can be opened. The use of a folding lid would encumber the accessibility to the washer basket. The use of an unhinged lid that merely rests on the washer cabinet top would present the inconvenience of removing it and then finding a place to set it while loading and unloading clothes.

SUMMARY OF THE INVENTION

The invention defines the combination of a clothes washer having a cabinet top with an access opening, a cabinet front, and cabinet sides, a base pivotally supporting the washer wherein it can be tilted from an upright position used for washing to a forward tilted position used for loading and unloading clothes through the opening, a lid seated in slidable engagement on the cabinet top in the upright washing position to cover the opening, and means connected to the lid for limiting forward movement wherein, when the washer is tilted forward causing the cabinet top to move forward, the cabinet top slides underneath the lid thereby using the movement of the washer to automatically remove the lid from the opening. It may be preferable that the lid be plastic such as propylene to provide a light-weight lid structure that silently and easily slides across the cabinet top. The invention may also comprises a clothes dryer mounted above the washer thereby restricting access to the opening of the washer in the upright washing position. Further, it may be preferable that an outer casing at least partially enclose the washer and dryer. Also, the forward movement limiting means may comprise a hinged arm connected between the lid and the outer casing.

The invention may also define the combination of a clothes washer having a cabinet top with an access opening, a cabinet front, and cabinet sides, a base pivotally supporting the washer wherein the washer can be tilted from an upright position used for washing to a forward tilt-out position used for loading and unloading clothes through the opening, a lid detachably resting on the cabinet top in the upright washing position to cover the opening, and means coupled to the lid for restraining its forward movement wherein, when the washer is tilted forward to the tilt-out position for loading and unloading clothes, the lid is automatically removed from the opening by sliding backward along the cabinet top as the cabinet top moves forward.

The invention may also be practiced by a combination clothes washer and dryer, comprising a clothes washer having a cabinet top with an recess surrounding an access opening, a cabinet front, and cabinet sides, an outer casing enclosing the sides and back of the washer, a front loading dryer stacked above the washer and supported by the outer casing, a base pivotally supporting the washer about a rotation axis wherein the washer is tiltable between an upright position used for washing and a forward tilt-out position providing access to the opening from underneath the clothes dryer for loading and unloading clothes, a lid detached from the washer seated at least partially in the recess in the upright washing position to cover the opening, and means within the outer casing for preventing movement of the lid out of the outer casing wherein, when the washer is tilted forward to the forward tilt-out position, the cabinet top moves forward sliding underneath the lid thereby automatically removing the lid from the opening as a result of tilting the washer forward. It may be preferable that the movement preventing means comprise a pair of arms each having one end pivotally connected to the back of the outer casing and each having its opposite end hinged to the sides of the lid. Also, it may be preferable that the lid have a sloped rear undersurface for providing sliding engagement with the rim of the recess.

The invention further defines a combination clothes washer and dryer, comprising a clothes washer having a cabinet with a front, sides, and a top, the cabinet having a bottom front truncation, the top having an opening for loading and unloading clothes, an outer casing surrounding the sides and back of the washer, a front loading dryer supported above the washer by the outer casing, a stable base positioned within the outer casing for pivotally supporting the washer wherein the washer is tiltable between an upright position used for operating the washer in washing cycles and a forward tilted position used for providing access through the top opening for loading and unloading clothes, a lid detached from the washer and resting on the cabinet top in the upright position to cover the opening during the washing cycles, and means coupled between the lid and the outer casing for preventing the lid from moving forward out of the casing wherein, when the washer is tilted forward, the lid slides backward along the cabinet top thereby providing automatic opening of the lid from the opening as a result of forward movement of the washer.

BRIEF DESCRIPTION OF THE DRAWINGS

The foregoing objects and advantages of the invention will be more fully understood by reading the description of the preferred embodiment with reference to the drawings wherein.

DESCRIPTION OF THE PREFERRED EMBODIMENT

Referring to

Figure 1:
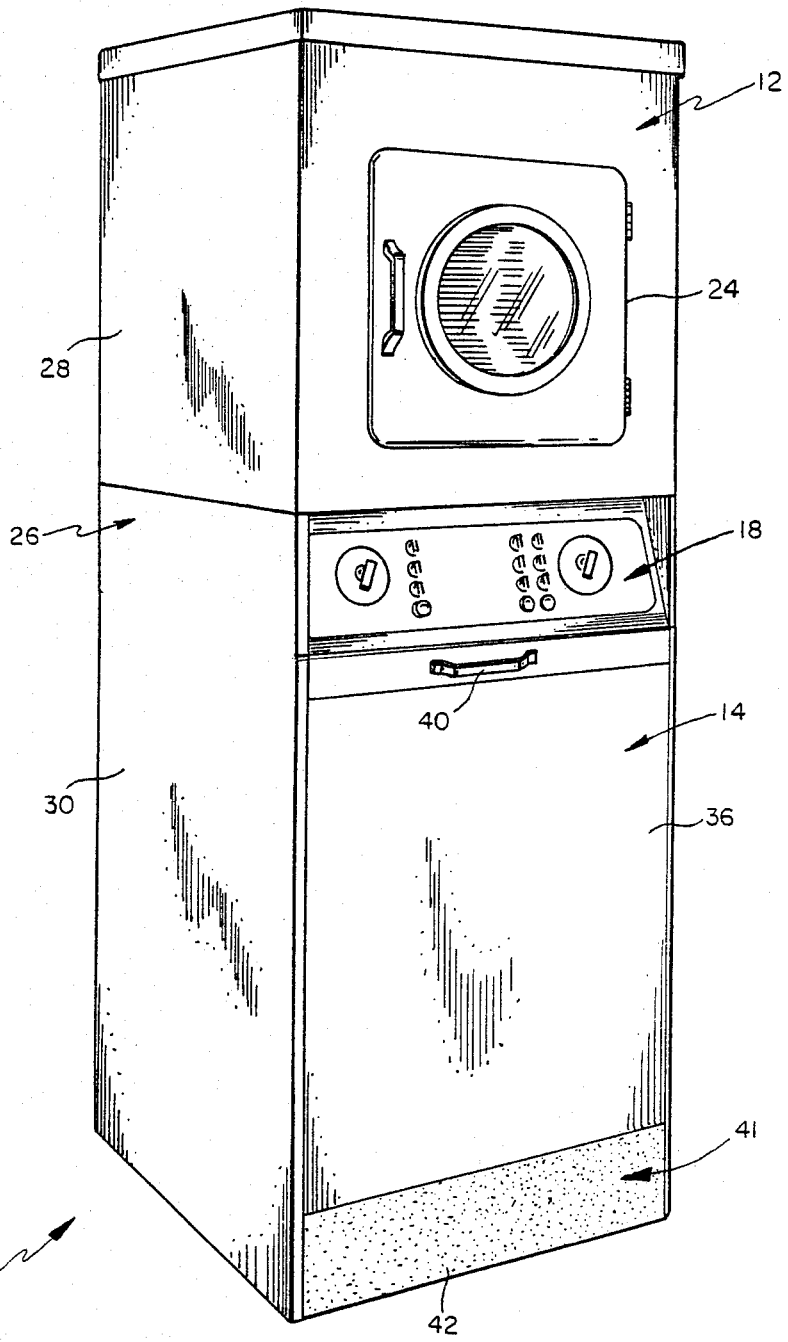
FIG. 1 is a perspective view of a stacked clothes washer and dryer combination.
Figure 2:
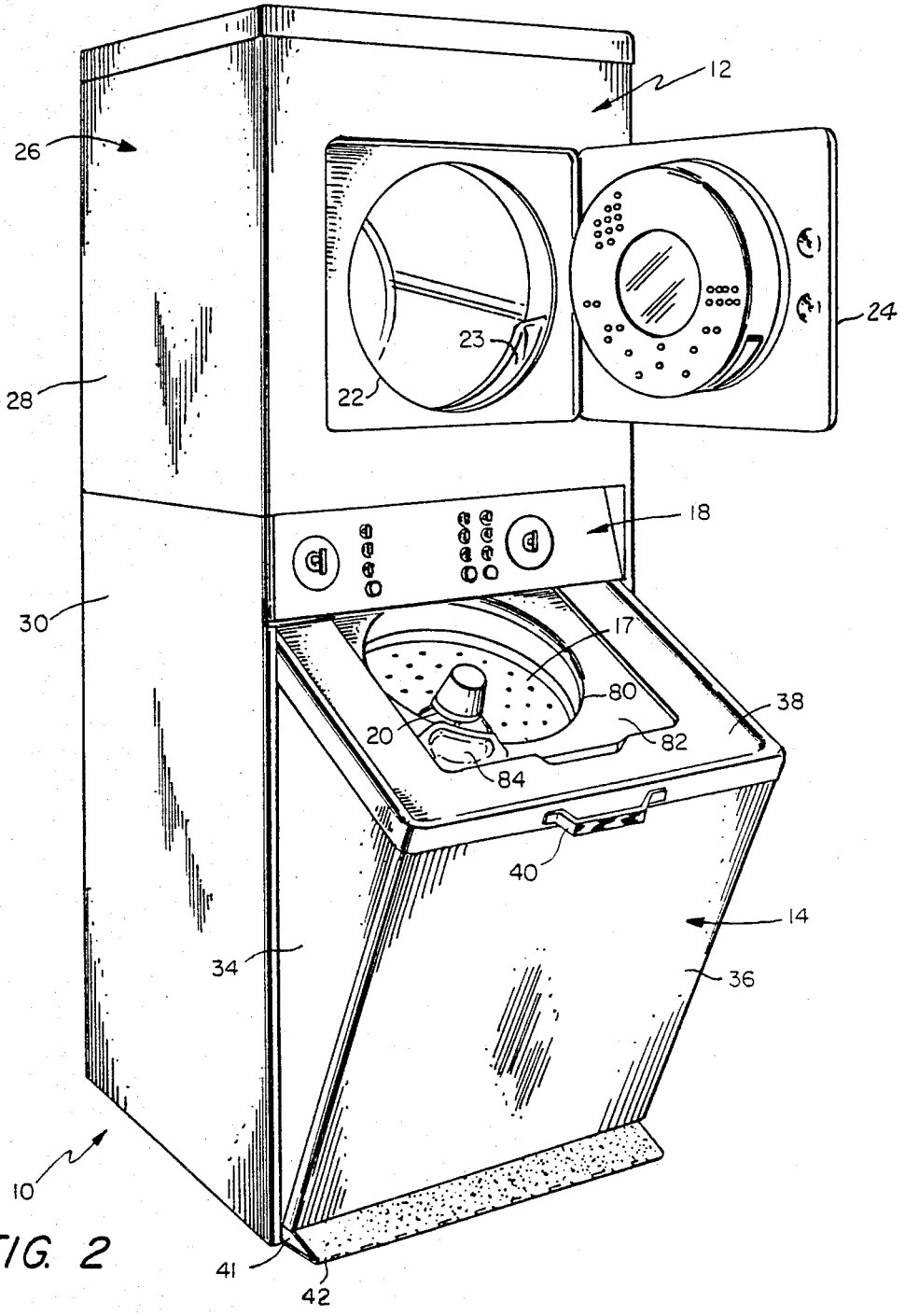
FIG. 2 is the combination of FIG. 1 with the washer tilted forward.

FIG. 1, there is shown a clothes washer and dryer combination 10 including a front loading dryer 12 stacked above a top loading washer 14 here depicted in its upright or closed position. FIG. 2 depicts washer 14 tilted forward to its open position thereby providing access to basket 17 within tub 16 (FIG. 4) for loading and unloading clothes. In operation, clothes are placed into basket 17 and, after detergent is added, washer 14 is returned to the upright position as shown in FIG. 1. Control panel 18 is then used to initiate washing cycles. For example, water is pumped into tub 16 and then agitator 20 provides washing agitation. Next, washer 14 would typically go through appropriate rinse and spin cycles. Many washing machine parts such as a motor, a transmission, pumps, hoses, and tub support apparatus are not shown in this or subsequent mechanical views because they are conventional and a detailed description of them is not necessary for an understanding of the invention.

After tilting washer 14 to the forward or open position as shown in FIG. 2, the washed clothes are then lifted out and placed up into dryer 12 through opening 22. After door 24 is closed, control panel 18 is used to control dryer 12 through a drying cycle. Dryer 12 may be of any suitable conventional design. Preferably, opening 22 is near the bottom of dryer 12 so that the operator does not have to lift the clothes higher than necessary. As an alternative to designing a dryer 12 having an opening 22 near the bottom of its chassis, it may be preferable to use a conventional dryer having a high opening and invert the unit to place the opening near the bottom. In such case, it may be desirable to relocate the lint filter 23 and associated duct (not shown).

Outer casing 26 here includes side panels 28 and 30. Panel 28 functions as the outer cabinet for dryer 12. However, washer 14 can tilt forward so it has its own side cabinets 34 while side panel 30 functions to encase washer 14 and provide support for dryer 12. Washer 14 also has a front cabinet 36 and top cabinet 38. It is unnecessary for washer 14 to have a rear cabinet because the back of washer 14 is permanently encased by back panel 39 (FIG. 4) of outer casing 26. Handle 40 is rigidly connected to the front of top cabinet 38 and is used to tilt washer 14 from its upright or closed position as shown in FIG. 1 to its forward or open position as shown in FIG. 2, and vice versa. As will be described in detail later herein, the bottom front of washer 14 is truncated and cover flap 42 functions to cover the truncation 41. Cover flap 42 is flexible such as rubber so that it bends outward when washer 14 is tilted forward as shown in FIG. 2.

Figure 3:
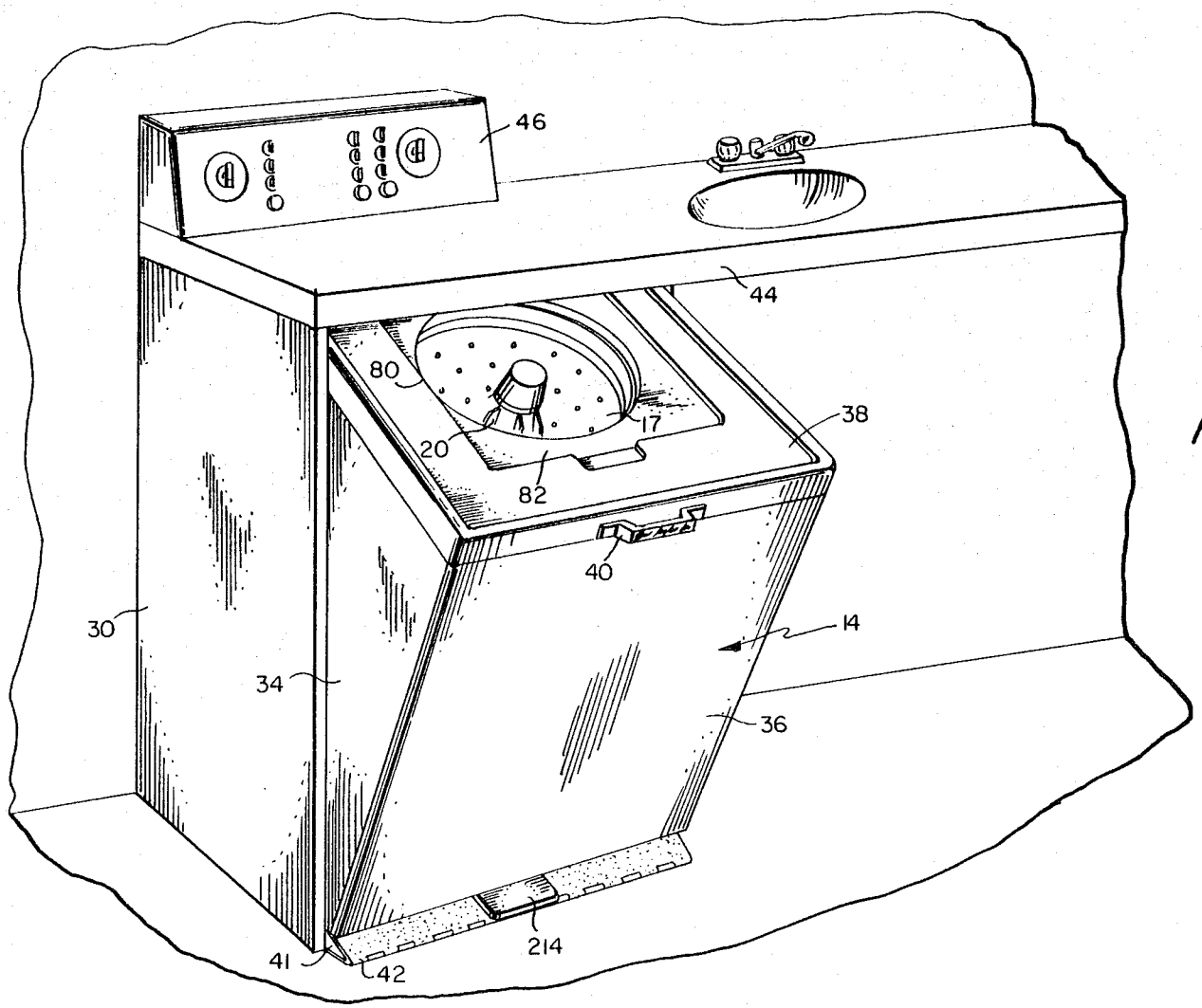
FIG. 3 is a tiltable washer under a countertop.

Referring to FIG. 3, an alternate embodiment or application for a tiltable washer is shown. More specifically, washer 14 is positioned below countertop 44 and is operated using wall mounted control panel 46. Also, washer 14 in FIG. 3 is shown with a foot pedal 214 used in providing a downward force to assist in tilting washer 14 forward.

Figure 4:
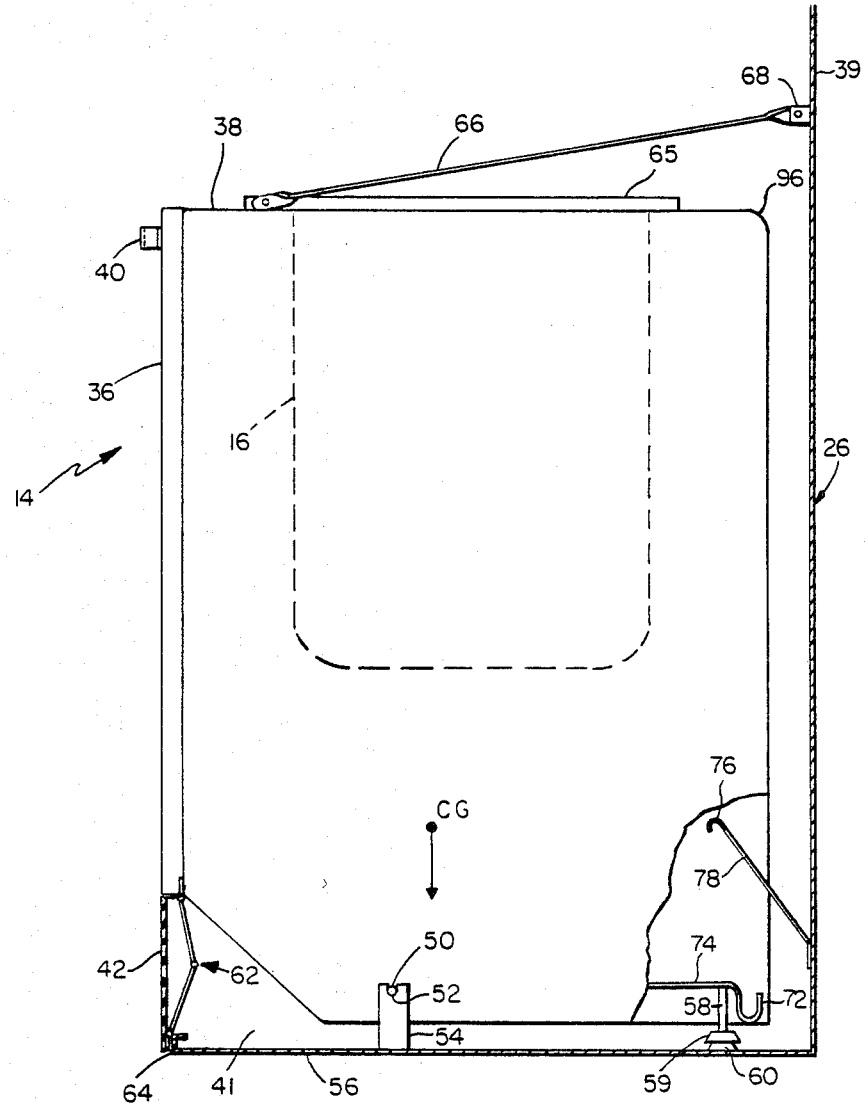
FIG. 4 is an illustrative side view of the washer in an upright position.
Figure 5:
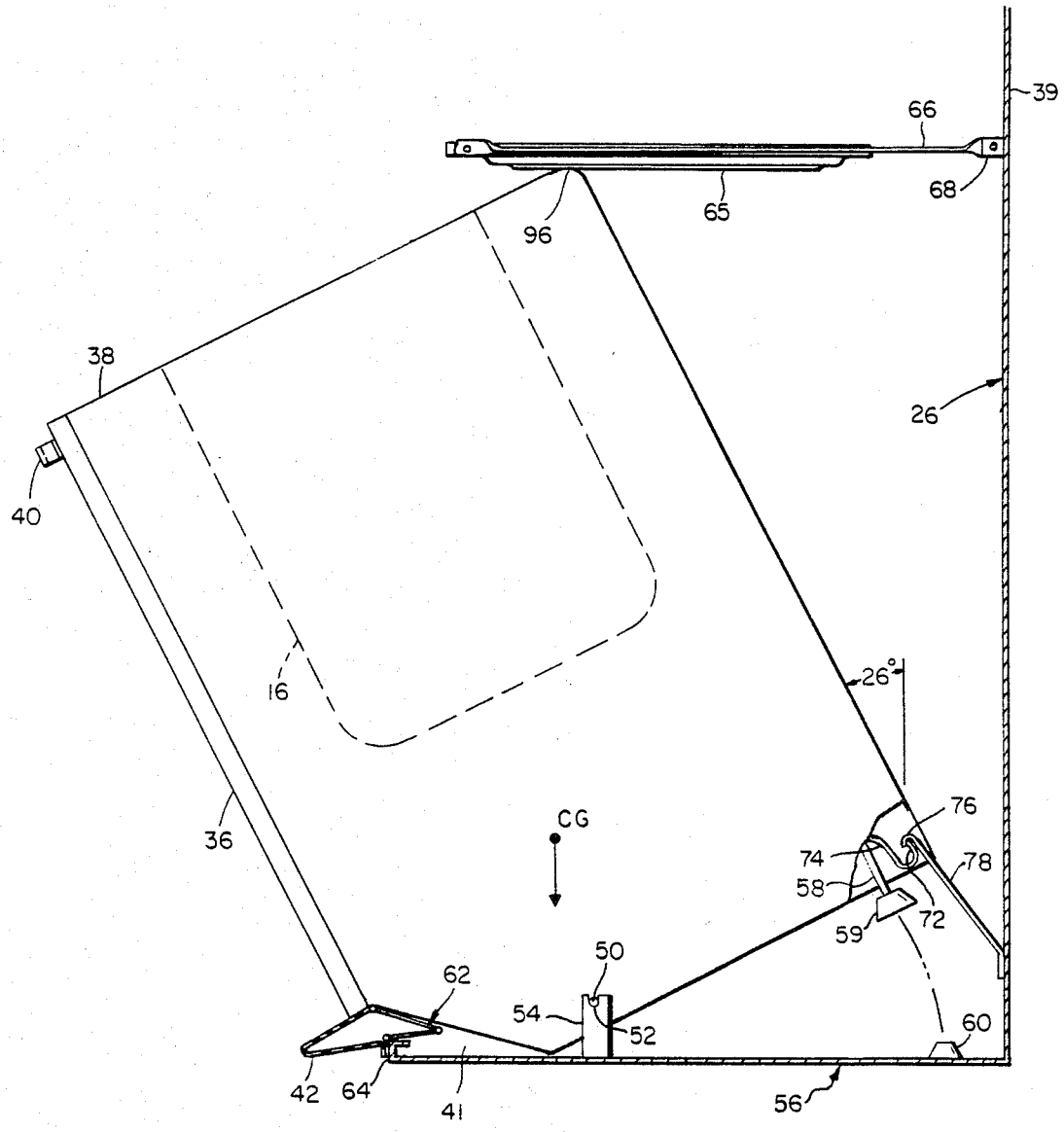
FIG. 5 is an illustrative view of the washer tilted forward.

Referring to FIGS. 4 and 5, illustrative side views of washer 14 in the upright and then forward positions are respectively shown. For illustration, side panel 30 is removed, washer 14 is partially broken away, and structural detail to be described later herein is omitted. Washer 14 is pivotally supported by cylindrical pivot pins 50 extending laterally from the sides of washer 14 from a point in front of the center of gravity CG of the washer 14 in its upright position and behind the truncation 41 of the bottom front as shown in FIG. 4. Pivot pins 50 on each side are axial and define a horizontal axis of rotation as they seat in grooves 52 of pivot support members 54 which are part of base 56. Pilot legs 58 connected to washer 14 have feet 59 with hollows 61 (FIG. 9) that insert over truncated conical pedestals 60 in the upright washing position as shown in FIG. 4. Feet 59 not only provide support for the rear of washer 14 in this position, but they also locate the washer and horizontally secure it to base 56. Toggle hinge 62, which will be described in more detail later herein, connects from the front of washer 14 above truncation 41 to the front 64 of base 56. Toggle hinge 62 is biased to provide an upward force on the front of washer 14 to resist the forward tilting of washer 14 to the position as shown in FIG. 5. More specifically, biased toggle hinge 62 exerts a backward torque on washer 14 which, in the upright position as shown in FIG. 4, firmly anchors feet 59 down on pedestals 60. Accordingly, in the upright position, a significant portion of the weight of washer 14 is carried by biased hinge 62 and feet 59 resulting in washer 14 being sufficiently stabilized so as to effectively limit movement and vibration which is particularly important during a high torque spin cycle. Typically, washer 14 may weight approximately 200 pounds. Washer lid 65 seats on top cabinet 38 when washer 14 is in its upright or closed position as shown in FIG. 4. The forward ends of arms 66 are pivotally connected to the respective sides of lid 65 near its front. The backward ends of arms 66 are pivotally connected to bracket 68 mounted to back panel 39 of outer casing 26.

Handle 40 is used to pull the top of washer 14 forward thereby effecting tilting about the horizontal rotational axis defined by pivot pins 50 and grooves 52. Initially, the force applied to handle 40 must both raise the center of gravity CG of washer 14 which is behind the rotational axis and overcome the upward torque force exerted on the front of washer 14 by biased toggle hinge 62. When the center of gravity of washer 14 is over pivot pins 50, the only force required to continue the forward tilting of washer 14 is that which is necessary to overcome biased toggle hinge 62. Then, when the center of gravity moves in front of pivot pins 50, the weight of washer 14 works to overcome biased toggle hinge 62. Finally, in a predetermined forward tilt position such as 26° as shown in FIG. 5, the rear lip 72 of the washer bottom platform 74 raises in an arc and engages a stop or hook 76 thereby preventing further rotation about pivot pins 50. Hook 76 which may have a noise dampening sheath 73 (FIG.8) is connected by neck 78 to the back of base 56. During movement of washer 14 from its closed postition as shown in FIG. 4 to its open position as shown in FIG. 5, the upward rotational arc of top cabinet 38 pushes lid 65 upward by sliding engagement because lid 65 is not attached by conventional means such as a hinge to top cabinet 38 and arms 66 prevent lid 65 from moving forward with top cabinet 38. Accordingly, lid 65 automatically opens when washer 14 is tilted forward thereby simplifying loading and unloading through washer top access opening 80.

Figure 6:
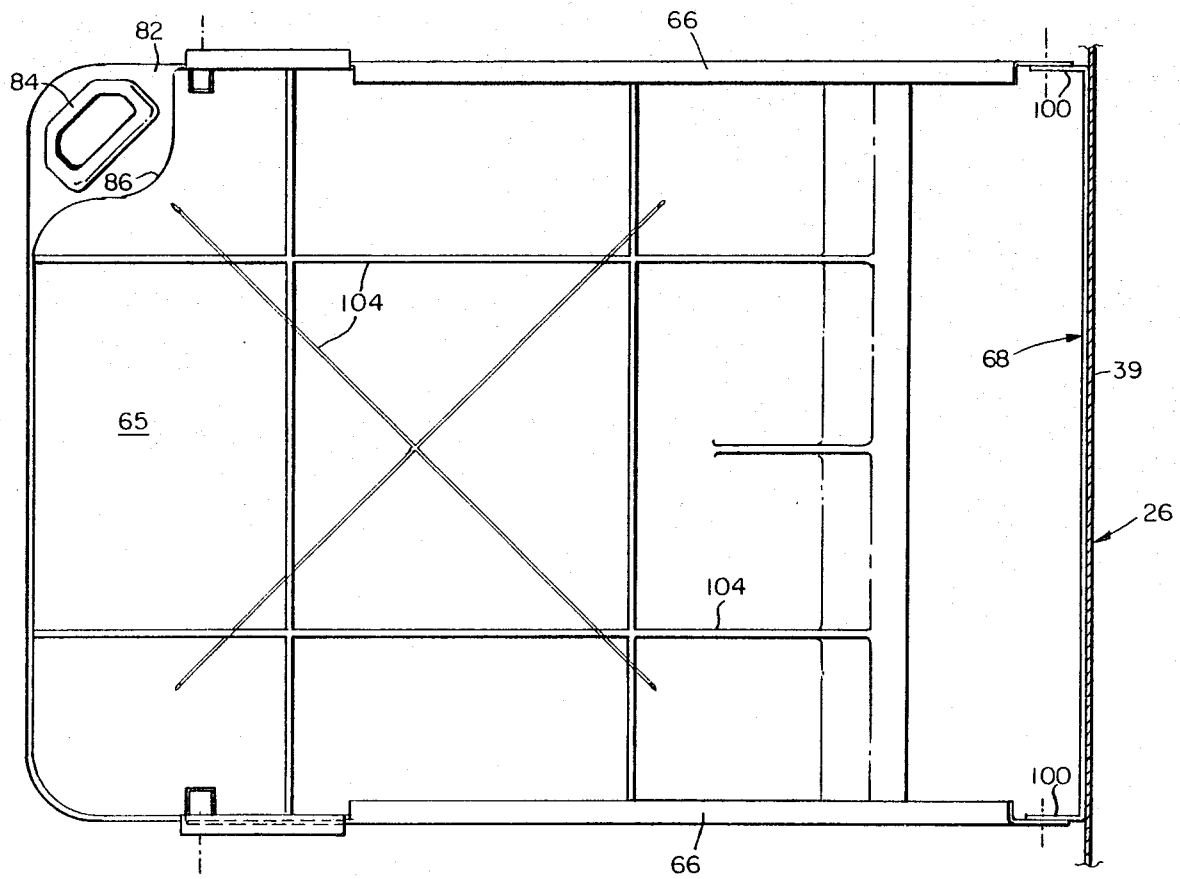
FIG. 6 is a top view of the washer lid.
Figure 7:
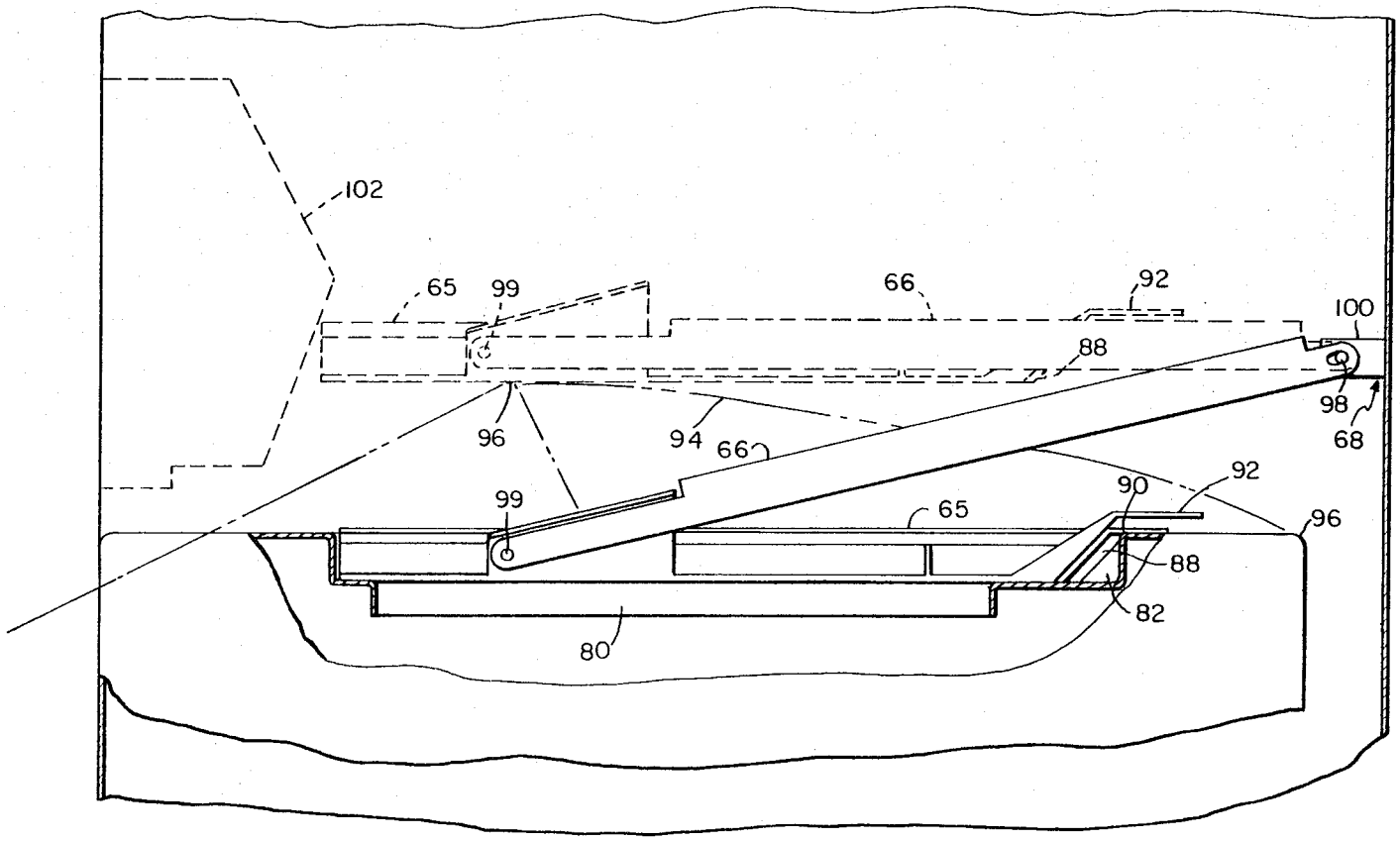
FIG. 7 is a side view of the washer lid.

Referring to FIGS. 6 and 7, respective top and side detailed views of washer lid 65 are shown. Washer lid 65 seats into top cabinet recess 82 which surrounds the washer top access opening 80. Typically, recess 82 may include a conventional bleach dispenser 84 that is slightly raised above the bottom surface of recess 82. Because lid 65 slides into place in recess 82 rather than the conventional approach of rotating downward about hinges, lid 65 has a corner notch 86 conformed to dispenser 84. In FIG. 7, lid 65 is in the solid line position when washer 14 is in the closed or upright position. Lid 65 is preferably sloped on the rear underside 88 so that it doesn't bind when being lifted by the top edge 90 of recess 82 when washer 14 is tilted forward about pivot pins 50. Lid 65 has a rim 92 which extends rearwardly above top cabinet 38 outside recess 82. The function of lid 65 is to prevent water and suds from splashing out of the tub 16 in an agitate cycle. For this purpose, it is only necessary that lid 65 cover opening 80; there is no need to have a tight fit within recess 82. In FIG. 7, lid 65 is in the dotted line position after it has been raised by the opening or forward tilting of washer 14. More specifically, line 94 shows the arc of the rear corner 96 of washer 14 as it is tilted about the rotational axis of pivot pins 50. As lid 65 is restrained from moving forward out from under dryer 12 or countertop 44 by arms 66, either edge 90 or corner 96 of washer 14 supports lid 65 and arms 66 and pushes them upward in sliding engagement as the washer is rotated. More specifically, U-shaped bracket 68 is connected to the back panel 39 of outer casing 26 by suitable means such as screws. A pivot fastener 98 connects the rear ends of arms 66 to the outward extending hands 100 of bracket 68. Arms 66 are connected by pivot fasteners 99 to the sides of lid 65 near its front and are lateral thereto so that in its raised position as shown by dotted lines in FIG. 7, lid 65 rises between arms 66. In such position, lid 65 is supported by the rear corner 96 of top cabinet 38. As shown, lid 65 in its raised position clears the back of controls 102 of control panel 18. As an alternate embodiment to arms 66, the forward motion of lid 65 could be restrained by suspending it from the underside of dryer 12 with cables.

Lid 65 is made of plastic such as polypropylene. In this embodiment where lid 65 is detached from the top cabinet 38 and is removed from opening 80 by sliding engagement with top cabinet 38, plastic has the advantage of being light-weight thereby reducing the friction between it and top cabinet 38. Also, plastic has self-lubricating properties to provide quiet operation. More specifically, if a conventional metal lid were used, it might create a grinding noise during sliding engagement with top cabinet 38 and cause a clank as it dropped into recess 82 during closing. Ribs 104 make lid 65 more rigid.

Figure 9:
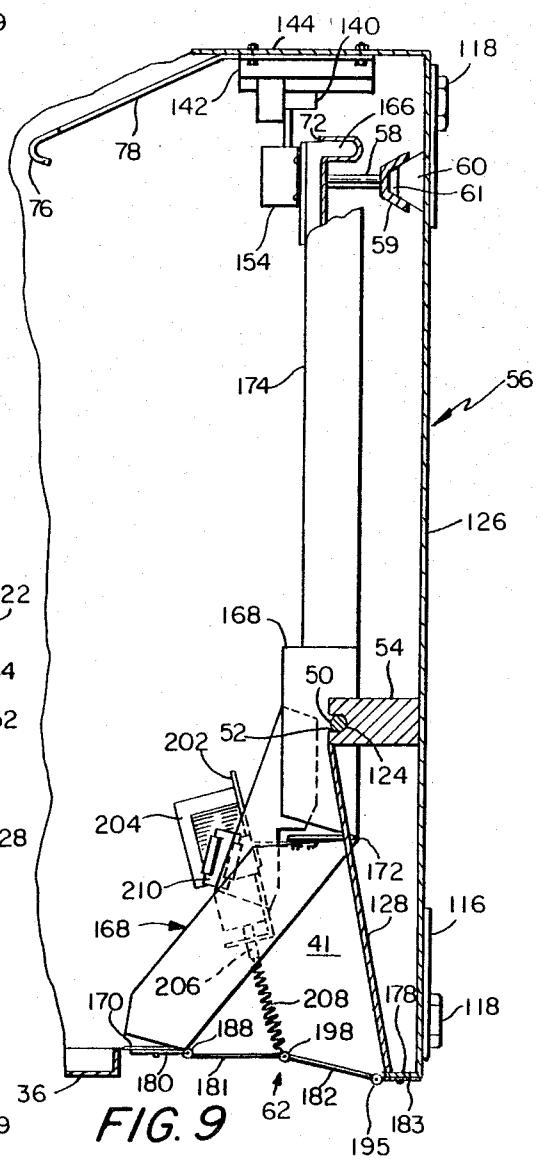
FIG. 9 is a view taken along 9—9 of FIG. 8.
Figure 8:
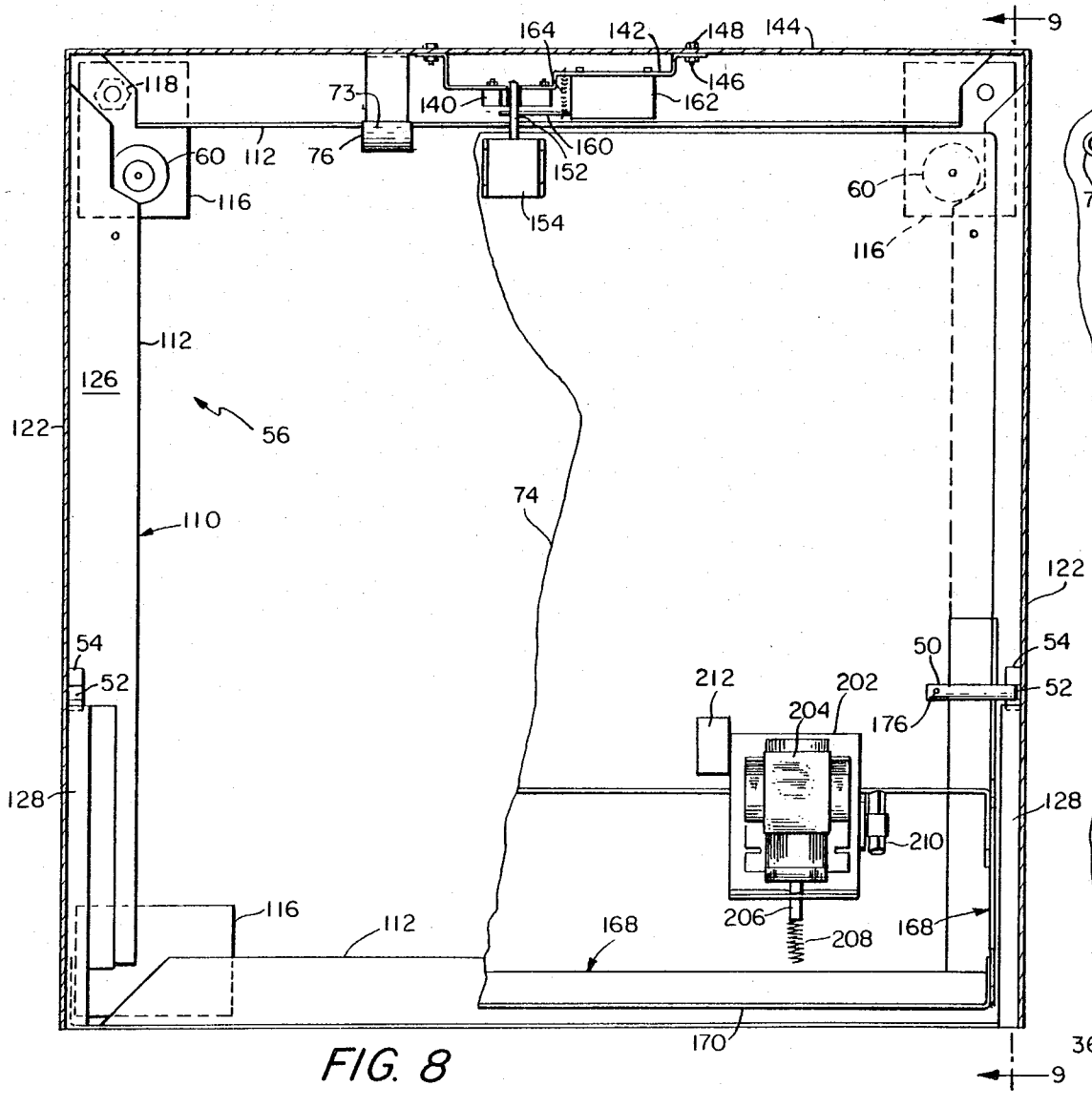
FIG. 8 is a top view of the washer base and a portion of the washer bottom platform.

Referring to FIG. 8, a top view of base 56 and a portion of the bottom platform 74 of washer 14 is shown including structure and details not depicted in FIGS. 4 and 5. FIG. 9 is a view taken along line 9—9 of FIG. 8. Base 56 is a sturdy support structure here defining a frame 110 having peripheral angle iron segments 112 connected by suitable means here welds to steel corner plates 116. Floor stands 118 mounted to the underside of plates 116 are adjustable for leveling. Rugged truncated conical pedestals 60 are securely attached by suitable means such as countersunk bolts (not shown) to the back plates 116. Feet 59 on pilot legs 58 have hollows 61 which align with and conform to pedestals 60. In the closed position of washer 14, hollows 61 receive pedestals 60 thereby horizontally securing washer 14 to base 56 to provide stability which is of great significance in the spin cycle. Pedestals 60 are fabricated of a hard, low-friction, noise dampening material such as plastic, or more particularly, nylon. Accordingly, there is no loud clank as feet 59 are firmly lowered onto pedestals 60. Also, vibration noises such as would occur during a spin cycle are minimized. As an example, the dimensions of base 56 may be approximately 27 inches square so that it will enclose and support a full size or large capacity washer 14. Approximately 9 inches back on each side of base 56 along side rails 122 are opposite pivot support members 54 which define axially aligned grooves 52. The cylindrical bottoms 124 of grooves 52 may be approximately 2 inches above the bottoms of slats 126 of base 54. Sloped tracks or ramps 128 connected along the side rails 122 between pivot support members 54 and the front of base 56 are used to support the pivot pins 50 while sliding washer 14 into or out of outer casing 26 for installation or repair.

Figure 10:
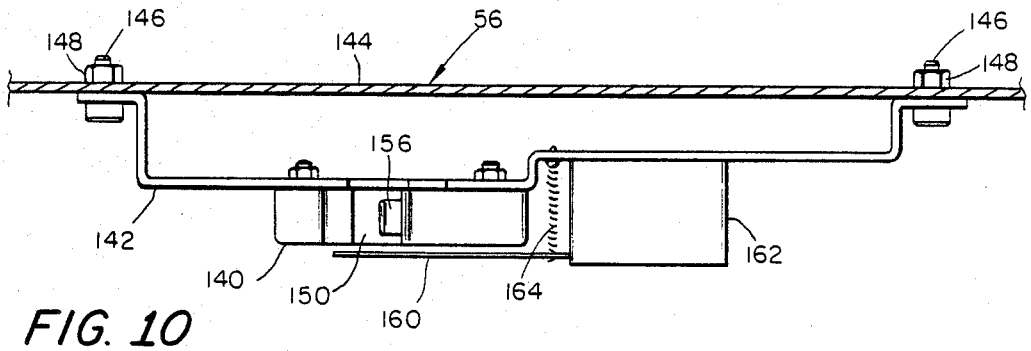
FIG. 10 is a top view of the washer latch.
Figure 11:
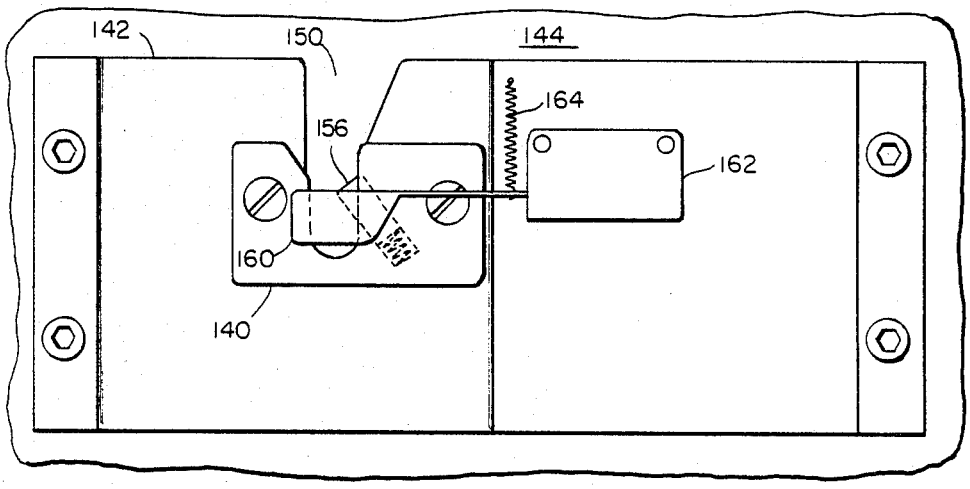
FIG. 11 is a front elevation view of the washer latch.
Figure 12:
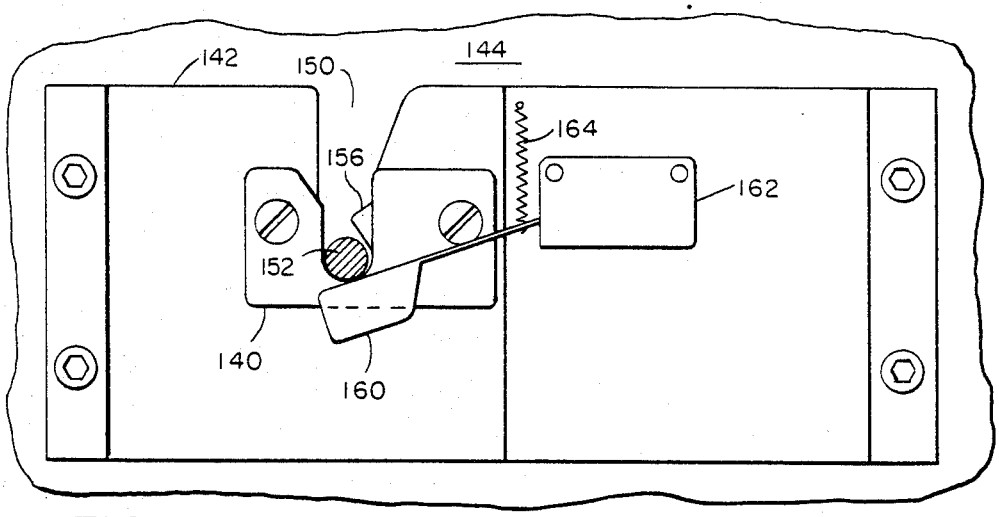
FIG. 12 is an alternate operational view of FIG. 11.

Still referring to FIGS. 8 and 9, latch 140 is connected to bracket 142 which is securely mounted to back rail 144 of base 56. More specifically, bracket 142, here connected to rail 144 by nuts 146 and bolts 148, spaces latch 140 away from back rail 144. An expanded top view of latch 140 and bracket 142 is shown in FIG. 10; expanded front elevation views are shown in FIGS. 11 and 12. Throat 150 of latch 140 is adapted for receiving a downward forced shaft, here plunger 152 of latch solenoid 154. More specifically, spring-loaded stop or tongue 156 permits lowering of plunger 152 but then locks plunger 152 to prevent its upward movement. Latch solenoid 154 is securely connected to the back of washer bottom platform 74 with cylindrical plunger 152 extending out over back lip 72 aligning so as to be received in throat 150 when washer 14 is in the upright position as shown in FIG. 1. More specifically, when washer 14 is tilted backward from its open position, plunger 152 drops into throat 150 pushing tongue 156 out of the way until plunger 152 moves to its downward position as shown in FIG. 12. There, tongue 156 snaps back engaging or locking washer 14 in its upright washing position. Accordingly, washer 14 is secured in its support position on pivot pins 50, pilot legs 58 and biased toggle hinge 62. Paddle 160 extending from latch switch 162, here a microswitch, is urged by spring 164 upward to cover the front of throat 150 as shown in FIG. 11. When plunger 152 drops down in throat 150 as shown in FIG. 12, plunger 152 depresses paddle 160 thereby altering the state of latch switch 162; the function of this will be described later herein. Also, as will be described, the release of the latching function is initiated by energizing latch solenoid 154 thereby retracting plunger 152. When plunger 152 is horizontally withdrawn from throat 150, paddle 160 is urged upward to the position shown in FIG. 11 thereby preventing the reentry of plunger 152 into throat 150 in a horizontal direction even though latch solenoid 154 may be deenergized.

Washer bottom platform 74 has an outer trough 166 around the back and sides to make the structure more rigid. Other indentations and contours used for mounting apparatus such as for tub 16 are not shown as they form no part of the invention. The front of what would otherwise be a conventional washer bottom platform is omitted and connected by suitable means such as welds in its place is truncation angle frame 168. As an example, the distance from the front 170 of truncated angle frame 168 to the back of washer bottom platform 74 may be approximately 24 inches with the height and depth of truncation 41 being approximately 5 inches and 6 inches, respectively. From the bottom 172 of truncation 41, the pivot pins 50 may preferably be about 8 inches towards the rear and truncation angle frame 168 may extend back past them to provide increased structural strength. Pivot pins 50 therefore attach to the washer bottom platform 74 inside troughs 166 and extend outward through holes in side lips 174 and angle frame 168. The axis of rotation defined by pivot pins 50 may be approximately 0.80 inches above the bottom of troughs 166. Pivot pins 50 are securely attached to washer bottom platform 74 by suitable means, here bolts 176. Side cabinets 34 which are not shown in FIG. 9 attach to the outside of side lips 174 of washer bottom platform 74 and also have a truncated front conforming to angle frame 168.

Figure 13:
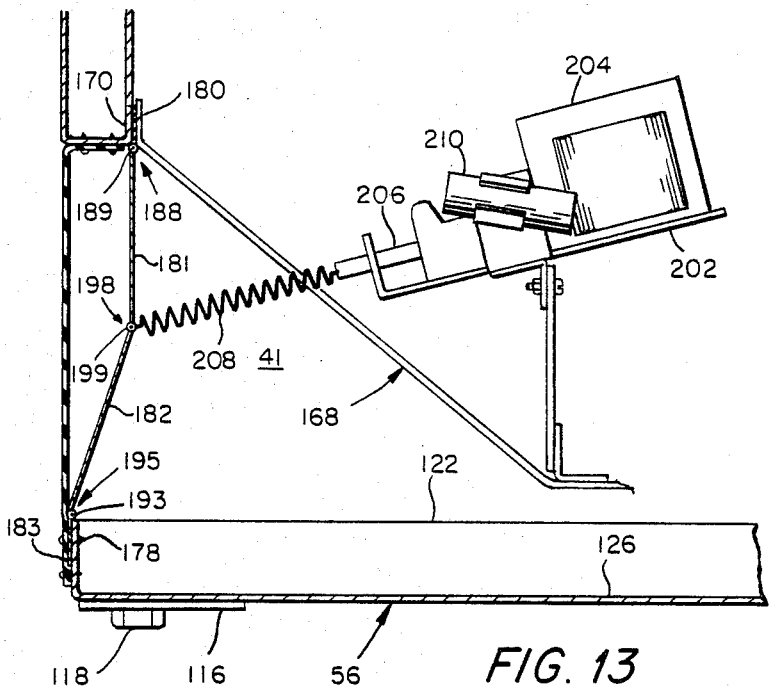
FIG. 13 is a side view of the biased hinge.
Figure 14:
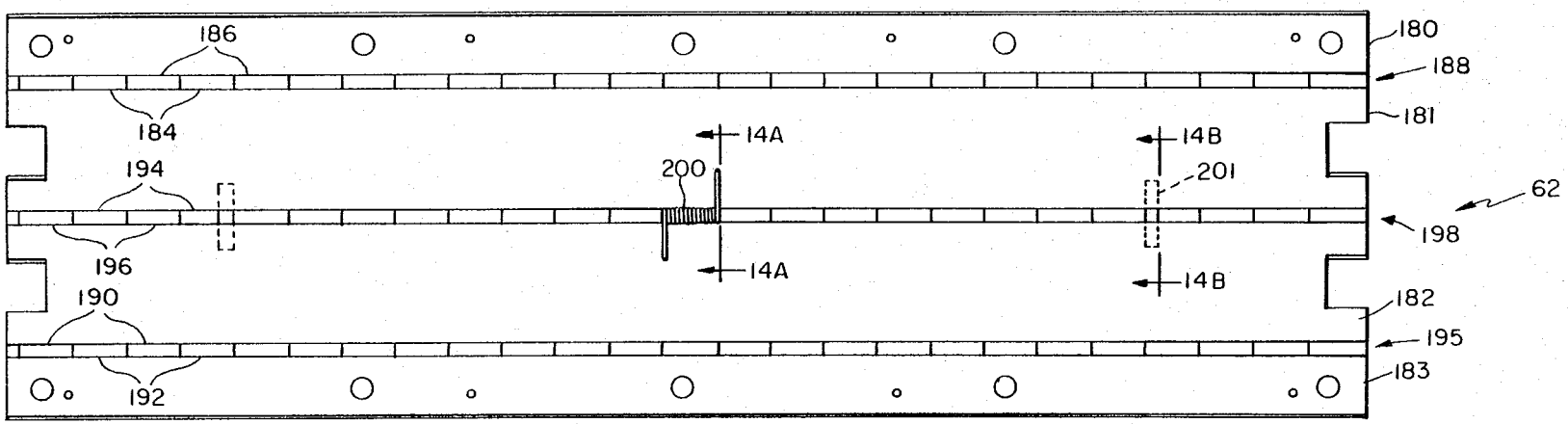
FIG. 14 is a front view of the biased hinge.
Figure 14B:
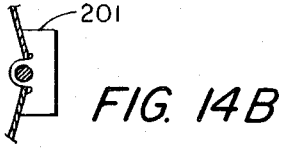
FIGS. 14*a* and 14*b* are side views taken along lines 14*a*–14*a* and 14*b*–14*b*, respectively.
Figure 14A:
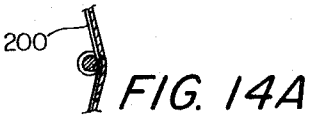

As briefly described earlier herein and as shown best in FIGS. 13 and 14, biased toggle hinge 62 connects from the front 170 of angle frame 168 of washer 14 to the front rail 178 of base 56. More specifically, biased toggle hinge 62 here consists of four lateral metal plates 180–183. Plate 180 is horizontally secured to front 170 of angle frame 168. The bottom of plate 180 has knuckles 184 which mate with nuckles 186 of plate 181 to form hinge joint 188 using rod 189. Similarly, plate 183 is horizontally secured to the front rail 178 of base 56 and its top has knuckles 190 which mate with knuckles 192 of plate 182 to form hinge joint 195 using rod 193. Further, knuckles 194 and 196 of plates 181 and 182 mate to form hinge joint 198 using rod 199. At least one of knuckles 194 or 196 is omitted and torsion spring 200 is inserted around rod 199 in its place. Torsion spring 200 urges plate 180 toward clockwise rotation as shown in FIG. 13 thereby putting a backward and upward force on washer 14 as described earlier herein. FIG. 14A shows a side view of torsion spring 200. FIG. 14B shows a side view of stop 201 which restricts the angle to which joint 198 can bend in one direction.

Shelf 202 is mounted to angle frame 168 as shown best in FIG. 13. Tilt-out assist solenoid 204 is affixed to shelf 202 and has plunger 206 directed towards hinge joint 198. A spring 208 is connected between plunger 206 and hinge joint 198 thereby providing a backward force on hinge joint 198 partially counteracting the torsion put on hinge joint 198 by torsion spring 200. As will be described later herein, energizing tilt-out assist solenoid 204 retracts plunger 206 thereby increasing the tension in spring 208. Accordingly, the pull force on handle 40 required to raise the center of gravity of washer 14 and overcome the torque of torsion spring 200 is thereby reduced. In short, by energizing tilt-out assist solenoid 204, it becomes easier to pull washer 14 to the open position as shown in FIG. 2. Mercury switch 210 is mounted adjacent to shelf 202. The state of mercury switch 210 is determined by the tilt angle of washer 14; its function will be described later herein. Also, tilt-out assist relay 212 is mounted on or near shelf 202; its function will also be described later.

Figure 15:
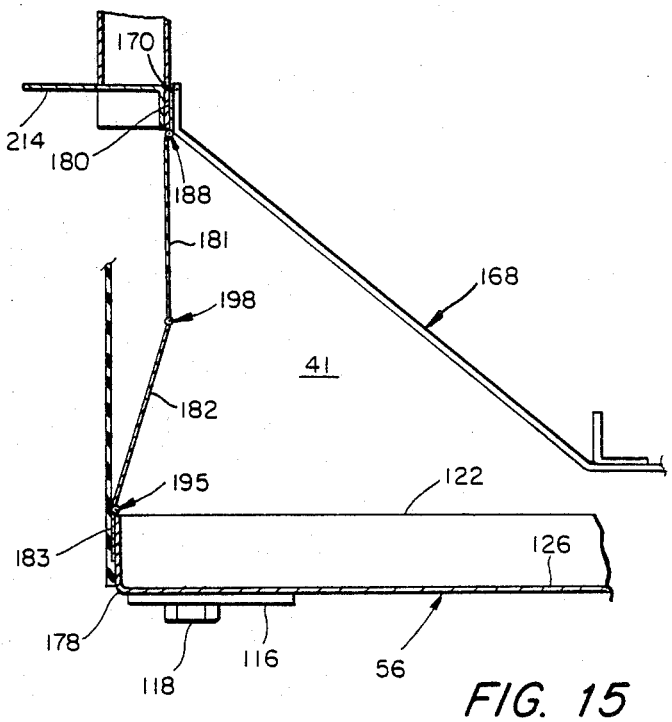
FIG. 15 is an alternate embodiment of FIG. 13.

As described earlier, it is important that tiltable washer 14 be stable in its upright washing position so as to minimize movement and vibration during washing cycles and particularly during a spin cycle. Further, it is important that an operator be able to tilt washer 14 forward and backward without using excessive force. These two objectives, however, are not totally compatible. With regard to stability, feet 59 carry the rear weight of washer 14 and horizontally secure it to base 56. Feet 59 firmly seat on pedestals 60 because the center of gravity CG of washer 14 is between feet 59 and the horizontal rotational axis defined by pivot pins 50 and because biased toggle hinge 62 urges rotation of washer 14 in a backward direction. For example, the center of gravity CG as indicated in FIG. 4 may preferably be more than an inch behind the rotational axis when washer 14 is in the upright washing position. It is noted that in modifying a conventional washer so as to have truncation 41, washer parts such as a motor or pumps may need to be relocated on bottom platform 74 and in so doing, the center of gravity CG can be optimally changed with respect to a selected rotational axis. Locating the center of gravity as described and providing torsion in biased toggle hinge 62 results in feet 59 and hinge 62 carrying a significant part of the weight of washer 14. Accordingly, it was found that stability during a spin cycle could be attained without using a locking device such as an over-center locking hinge. It is noted that latch 140 is used to prevent manual tilting of washer 14 and does not function as a spin cycle absorbing lock; in fact, if latch 140 were integrally used to assist in spin cycle stabilization, it would produce excessive noise and would wear. In the described embodiment, it was found that without tilt-out assist solenoid 204, a force of approximately 18–20 pounds was required on handle 40 to initiate forward tilting of washer 14. To reduce this pull-out force, tilt-out assist solenoid was added and it was found that the pull-out force was reduced to approximately 6 or 8 pounds. For example, tilt-out assist solenoid 204 with a pull-in force of approximately 20 pounds is used to exert a 14-pound backward force on hinge joint 198. In the described embodiment where washer 14 is tilted forward approximately 26° or 27°, the force required to close washer 14 was slightly larger than the pull-out force, but this was considered acceptable because it is generally easier for the operator to obtain leverage to close the washer. Referring to FIG. 15, an alternate embodiment of FIG. 13 is shown. More specifically, in lieu of tilt-out assist solenoid 204, foot pedal 214 is provided and the operator may use it to assist in providing the required pull-out force.

Figure 16:
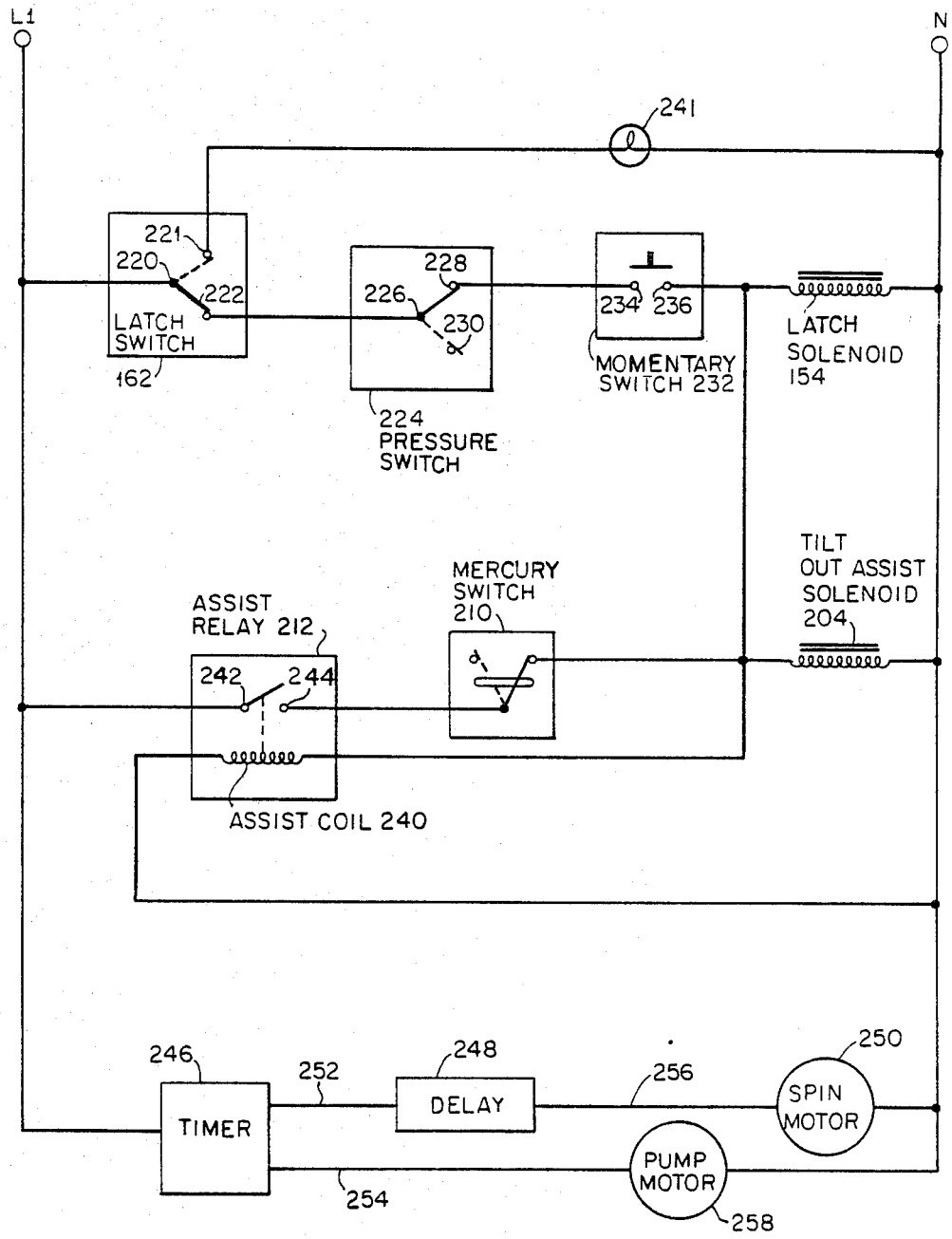
FIG. 16 is a schematic of the washer control.

Referring to FIG. 16, a schematic of the control of washer 14 is shown. As is conventional, N identifies the neutral line and L1 identifies a 110 volt single phase line. As described earlier, latch switch 162 has a paddle 160 which is urged by spring 164 to a position where it covers throat 150. When the washer 14 is upright and the plunger 152 of latch solenoid 154 extends into the throat 150 of latch 140, paddle 160 is pushed downward and contact 220 is connected to contact 222 as indicated by the solid line. Conventional single level pressure switch 224 is connected to tub 16. When the water level is below a predetermined level such as, for example, 3 inches, contact 226 of pressure switch 224 is connected to contact 228 as shown by the solid line. If there is a greater pressure on pressure switch 224 indicative of there being more than the predetermined level of water in tub 16, then pressure switch 224 is open as defined by contact 226 being connected to contact 230 as indicated by the dotted line. Momentary push button switch 232 on control panel 18 is activated by the operator to tilt washer 14 to its open position. Provided plunger 152 is locked in latch 140 and there is less than the predetermined level of water in tub 16, connecting contacts 234 and 236 of momentary switch 232 provides 110 volts AC across latch solenoid 154. Energizing latch solenoid 154 causes plunger 152 to be withdrawn from latch 140. Accordingly, as the latching function of latch 140 is released, paddle 160 is urged upward by spring 164 and then, even if latch solenoid 154 is deenergized, plunger 152 is prevented from reentering throat 150 of latch 140 by paddle 160. Paddle 160 moving to the position in front of throat 150 as shown in FIG. 11 also causes contact 220 in latch switch 162 to be connected to contact 221 as indicated by the dotted line thereby placing 110 volts AC across tub light 241 turning it on. Simultaneous to latch solenoid 154 being energized, tilt-out assist solenoid 204 is energized and current also flows through assist coil 240 of tilt-out assist relay 212. As described earlier, the retraction of plunger 206 of tilt-out assist solenoid 204 provides greater tension on spring 208 thereby reducing the force on handle 40 that is required to tilt washer 14 forward to the open position. Current flowing through assist relay coil 240 of tilt-out assist relay 212 causes normally open contacts 242 and 244 to close. Because mercury switch 210 is closed because washer 214 is in an upright position, 110 volts AC continues to be provided to tilt-out assist solenoid 204 and tilt-out assist coil 240 even though the circuit through latch switch 162 and momentary switch 232 is broken by either paddle 160 moving to its upward position or momentary switch 232 being released. Accordingly, current continues to activate latch solenoid 154 and tilt-out assist solenoid 204 until washer 14 is tilted to some predetermined rotation, here 14°, at which time mercury switch 210 opens thereby breaking the circuit therethrough.

Washer timer 246 is of conventional design and is used to control various washing cycles. In a conventional washer, the pumping of water out of the tub and the spinning operation are generally initiated simultaneously. As shown in FIG. 16, however, delay 248 is connected between spin motor 250 and conventional timer 246 so that even though signals are output on lines 252 and 254 calling for simultaneous spinning and pumping, the signal on line 256 to the spin motor is delayed until most of the water is pumped out of tub 16. For example, delay 248 may provide a delay of approximately one minute between the time that pump motor 258 starts and spin motor 234 is activated. At an illustrative pumping rate of 10.5 gallons per minute, 10.5 gallons would be pumped from tub 16 before the motor for spinning is activated. The reason for pumping water before spinning is that washer 14 does not have an out-of-balance switch. Because of the weight, it would be most difficult and impractical to open washer 14 when it is full of water. In actual practice, the spin operation and the pump are typically driven by the same motor; in such case, motors 250 and 258 in FIG. 16 would designate the couplers between the motor and the respective loads.

Figure 17:
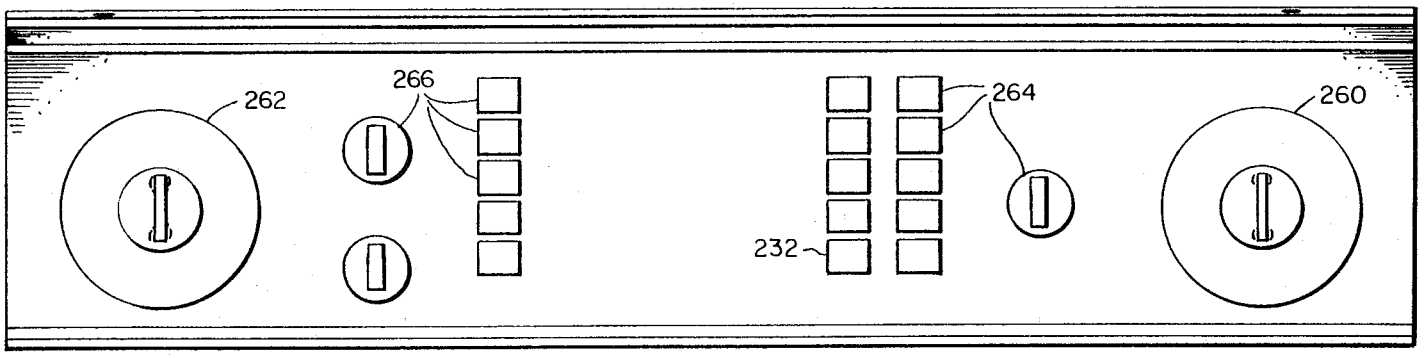
FIG. 17 is the washer control panel.

Referring to FIG. 17, a view of control panel 18 is shown. Washer 14 controls are on the right side and dryer 12 controls are on the left side. An illustrative washing and drying operation will be summarized. Initially, washer 14 is assumed to be in an upright position as shown in FIG. 1 with plunger 152 of latch solenoid 154 inserted in the throat 150 of latch 140 thereby preventing washer 14 from being tilted forward. In such state, contact 220 of latch switch 162 is connected to contact 222. When the operator depresses momentary switch 232 closing contacts 234 and 236, latch solenoid 154 is energized provided less than 3 inches of water are in tub 16 so that contacts 226 and 228 of single level pressure switch 224 are connected. If not, the latching or locking function cannot be disengaged by latch solenoid 154 because it is desirable not to have the operator attempt to tilt the washer forward when it is heavy with water. The momentum of opening a washer full of water could tip over washer and dryer combination 10 or could cause water to splash out. Simultaneous to latch solenoid 154 being energized thus deactivating the locking of washer 14, tilt-out assist solenoid 204 is also energized. Tub light 241 is turned on and tilt-out assist solenoid 204 continues to be energized until washer 14 is tilted forward to a point where mercury switch 210 is horizontal at which time mercury switch 210 is opened and tilt-out assist solenoid is deactivated. After loading clothes into basket 17 and detergent added, washer 14 is returned to its upright position where plunger 152 is engaged by tongue 156 in throat 150 thereby locking the washer in the upright washing position. In order to minimize vibrational forces on latch 140, torsion spring 200 continues to urge the rear of washer 14 to seat feet 59 firmly on truncated conical pedestals 60. Controls 264 are used to set desired washing parameters such as water level and temperature. Then, timer control 260 is activated. At the completion of the appropriate agitate and rinse cycles, the water is pumped out of tub 16 for approximately 1 minute before spinning is initiated. Next, following the same procedure for opening washer 14 as described above, the clothes are lifted to dryer 12 for drying. Drying parameters are set by controls 266 and drying timer 262 is activated.

This completes the description of the preferred embodiment. For those skilled in the art, the teaching herein will bring to mind many alterations and modifications without departing from the spirit and scope of the invention. Accordingly, it is intended that the scope of the invention be limited only by the appended claims.

What is claimed is:

1. In combination:

a clothes washer having a cabinet top with an access opening, a cabinet front, and cabinet sides;

a base pivotally supporting said washer wherein said washer can be tilted from an upright position used for washing to a forward tilted position used for loading and unloading clothes through said opening;

a lid seated in slidable engagement on said cabinet top in said upright washing position to cover said opening; and means connected to said lid for limiting forward movement of said lid wherein, when said washer is tilted forward causing said cabinet top to move forward, said cabinet top slides underneath said lid thereby using the movement of said washer to automatically remove said lid from said opening.

2. The combination recited in claim 1 wherein said lid is plastic.

3. The combination recited in claim 1 further comprising a clothes dryer mounted above said washer thereby restricting access to said opening of said washer in said upright washing position.

4. The combination recited in claim 3 further comprising an outer casing at least partially enclosing said washer and said dryer.

5. The combination recited in claim 4 wherein said forward movement limiting means comprises a hinged arm connected between said lid and said outer casing.

6. In combination:

a clothes washer having a cabinet top with an access opening, a front, and cabinet sides;

a base pivotally supporting said washer wherein said washer can be tilted from an upright position used for washing to a forward tilt-out position used for loading and unloading clothes through said opening;

a lid detachably resting on said cabinet top in said upright washing position to cover said opening; and means coupled to said lid for restraining forward movement of said lid wherein, when said washer is tilted forward to said forward tilt-out position for loading and unloading clothes, said lid is automatically removed from said opening by sliding backward along said cabinet top as said cabinet top moves forward.

7. The combination recited in claim 6 wherein said lid is plastic.

8. A combination clothes washer and dryer, comprising:

a clothes washer having a cabinet top with a recess surrounding an access opening, a cabinet front, and cabinet sides;

an outer casing enclosing the sides and back of said washer;

a front loading dryer stacked above said washer and supported by said outer casing;

a base pivotally supporting said washer about a rotation axis wherein said washer is tiltable between an upright position used for washing and a forward tilt-out position providing access to said opening from underneath said clothes dryer for loading and unloading clothes;

a lid detached from said washer seated at least partially in said recess in said upright washing position to cover said opening; and means within said outer casing for preventing movement of said lid out of said outer casing wherein, when said washer is tilted forward to said forward tilt-out position, said cabinet top moves forward sliding underneath said lid thereby automatically removing said lid from said opening as a result of tilting said washer forward.

9. The combination recited in claim 8 wherein said lid is plastic.

10. The combination recited in claim 8 wherein said lid is polypropylene.

11. The combination recited in claim 8 wherein said movement preventing means comprises a pair of arms each having one end pivotally connected to said back of said outer casing and each having its opposite end hinged to the sides of said lid.

12. The combination recited in claim 8 wherein said lid has a sloped rear undersurface for providing sliding engagement with the rim of said recess.

13. A combination clothes washer and dryer, comprising:

a clothes washer having a cabinet with a front, sides, and a top, said cabinet having a bottom front truncation, said top having an opening for loading and unloading clothes;

an outer casing surrounding the sides and back of said washer;

a front loading dryer supported above said washer by said outer casing;

a stable base positioned within said outer casing for pivotally supporting said washer wherein said washer is tiltable between an upright position used for operating said washer in washing cycles and a forward tilted position used for providing access through said top opening for loading and unloading clothes;

a lid detached from said washer and resting on said cabinet top in said upright position to cover said opening during said washing cycles; and means coupled between said lid and said outer casing for preventing said lid from moving forward out of said casing wherein, when said washer is tilted forward, said lid slides backward along said cabinet top thereby providing automatic removal of said lid from said opening as a result of forward movement of said washer.

14. The combination recited in claim 13 wherein said lid is plastic.

15. The combination recited in claim 13 wherein said lid is raised upwardly by sliding engagement with said cabinet top as said washer is tilted forward.

* * * * *